United States Patent [19]

Nelligan et al.

[11] Patent Number: 4,503,972

[45] Date of Patent: Mar. 12, 1985

[54] MICRODRILL PACKAGE

[75] Inventors: Jerome M. Nelligan, Matteson; Dale R. Heminover, Chicago, both of Ill.

[73] Assignee: Federal-Mogul Corporation, Southfield, Mich.

[21] Appl. No.: 497,068

[22] Filed: May 23, 1983

[51] Int. Cl.[3] ..... B65D 85/24; B65D 81/06

[52] U.S. Cl. ..... 206/379; 206/369; 206/383; 206/588; 211/69

[58] Field of Search ..... 206/379, 369, 368, 380, 206/382, 372; 211/69, 69.5, 60 T

[56] References Cited

U.S. PATENT DOCUMENTS

| | | | |
|---|---|---|---|
| 1,187,566 | 6/1916 | Taylor | 206/382 |
| 2,962,154 | 11/1960 | Falk | 206/379 |
| 2,971,637 | 2/1961 | Simons | 206/369 |
| 3,072,244 | 1/1963 | Smith | 206/369 |
| 3,084,788 | 4/1963 | Ford | 206/383 |
| 3,227,265 | 1/1966 | Schneider | 206/382 |
| 3,248,167 | 4/1966 | Friedman | 206/369 |
| 3,367,483 | 2/1968 | Studen | 206/379 |
| 3,469,687 | 9/1969 | Schneider | 206/382 |
| 3,506,113 | 4/1970 | Garnier | 206/369 |
| 3,834,409 | 9/1974 | Kuparinen | 211/69.5 |
| 3,973,863 | 8/1976 | Smith | 211/69 |
| 4,253,830 | 3/1981 | Kazen | 206/368 |

*Primary Examiner*—William T. Dixson, Jr.
*Attorney, Agent, or Firm*—Robert F. Hess

[57] ABSTRACT

A package structure supports and protects a plurality of microdrills, the microdrills being resiliently mounted such that the delicate drill bodies are located spaced from one another and spaced from their support in a contact-free manner in order to eliminate or minimize breakage during transport and handling.

22 Claims, 5 Drawing Figures

MICRODRILL PACKAGE

BACKGROUND OF THE INVENTION

1. Field of the Invention

The present invention relates to a package for drills, and is more particularly concerned with a package for supporting and protecting microdrills.

2. Description of the Prior Art

Containers for supporting various types of tools, including drills, are well known in the art. For example, in U.S. Pat. No. 2,962,154 of Joseph Falk, a drill kit is disclosed in which drill bodies extend through respective apertures in a central plate and are stopped from downward movement by engagement of the forward ends of the drill shanks with the upper surface of that plate. An upper plate has larger apertures for receiving the drill shanks. Upward movement of the drill bodies is prevented by the inside surface of a cover. In the open condition of the case, the cover serves as a forward rest and the junction of the wall to which the cover is attached and the bottom of the case serves as a rear rest. In this position, the drill bits tilt, the apertures for the shanks being greater than the cross-sectional dimensions of the shanks, so that the drill bodies receive torque, perhaps even a snapping action, at the junction of the drill bodies with the shanks. This structure cannot serve for supporting and protecting microdrills in that the extremely fine drill bodies would rupture when the case is opened and pivoted to the above-described condition for access to the drills.

Joseph Schneider in U.S. Pat. No. 3,469,687 discloses a container for packaging needles in which the smaller, forward end of the needle is received in a vertical passageway with the needle point bearing against a closed end of the passageway. At the shank end of the needle, a resilient cushion is disposed between the ends of the shanks and an upper wall of the container. This type of package is also unsuitable for microdrills in that, again, the drill bodies are extremely delicate and would rupture if subjected to this type of self-support.

In U.S. Pat. No. 1,187,566 Leila M. Taylor discloses an aseptic container for long handle broaches used, for example, by dentists. In this structure, a cavity is provided with a dividing wall having depending hollow tapered cones for receiving complementally shaped broach handles. The broach itself extends through the open bottom end of the cone. With this structure, therefore, the broaches are held spaced apart in a depending condition and are accessible from the handle or shank end when an upper cover is removed.

Charles E. Studen in U.S. Pat. No. 3,367,483 discloses a container with a sliding cover for housing elongate bodies, such as drill bits. A resilient liner has horizontal grooves therein for receiving the drill bits which are removed by depressing the rear end of the shank to elevate the drill body out of the container. This is unacceptable for microdrills in that the drill bodies are fragile and should not be handled with the fingers, as would be required to remove a drill bit after depression of the rear end of the shank.

In U.S. Pat. No. 3,072,244 Joseph L. Smith discloses a display capsule for dental burrs which comprises a transparent bottle with a screw cap. The shanks of the dental burrs are received in bores. To remove a burr, the cap is removed to release the upper end of a rod connected in the burr holder. The burr holder is spring loaded so as to move upwardly and move the burrs out of the bottle. The dentist may then select and remove the desired burr. This is unacceptable for microdrills in that one is required to remove a drill by grasping the drill body end.

Conventionally, packaging for microdrills has been somewhat along the lines of Smith in which a plate has a plurality of bores therein for receiving the shafts of the microdrills. A pair of covers are pivoted to the plate to close about the same and protect the microdrills in such a manner that they do not contact one another and are in a contact free cavity. However, with this type of package, the microdrills must be removed from the drill body end. Further complicating this matter, the shafts must have a fairly high frictional contact with the bores so that the microdrills are not inadvertently moved out of the bores, which would result in breakage of the delicate drill bodies.

SUMMARY OF THE INVENTION

It is the object of the present invention to provide a new and improved microdrill package which will support and protect a plurality of microdrills.

According to the invention, the above object is achieved by providing a package structure for supporting and protecting a plurality of microdrills, each of which includes a shank and a drill body, in which a case is provided with a bottom, a plurality of sidewalls and a cover for closing the case. A cavity is formed in the lower section of the case between the sidewalls and internal wall and the bottom. The cavity is preferably formed with a resilient inner wall and resilient rings extending about the internal surfaces of the sidewalls in the lower section of the case. The microdrills are held in place with the drill bodies separate and free of any contact with each other and with the case. In one embodiment of the invention the internal wall is provided with an array of passageways therethrough for receiving the drill shanks. In this embodiment, the holding of the microdrills is provided by fitting each microdrill with a resilient tube at the free end thereof, the forward surface of the tube acting as a stop against the upper surface of the internal wall and the rear end of the tube engaging and acting as a stop against the cover when the cover is closed. In another embodiment, the passageways are shaped to conform to the shank and to a conical section which connects the shank to the drill body. In this embodiment, the surface of the conical section engages and is stopped by the complemental surface of the passageway, and the cover engages the free end of the shank to form a stop in the opposite direction.

In both embodiments set forth above, the cover may be hinged and provided with a latch, or it may be a sliding cover. Also, in both embodiments, the drill bits are positioned with the drill bodies free of contact in the cavity and, with the cover open, access to and simple withdrawal of a microdrill is provided from the shank end so as to eliminate, or at least minimize, breakage.

Preferably, at least the bottom of the case is transparent so that the microdrill bodies may be inspected without opening the package.

A package constructed in accordance with the present invention offers the following advantages:

1. The drill body is held in midair with no contact to its support or to another drill body;

2. The inner support wall, and preferably its support spacing ring or rings, are constructed of shock-absorbing material, such as polyfoam, polyurethane or the like, to absorb mechanical shock during transport and handling;

3. The microdrills are removable, very advantageously from the shank end, without proximity of the delicate drill bodies to any other structure;

4. The microdrill bodies can be inspected through the transparent bottom while the case is closed; and 5. The microdrills are protected in the workplace, even when the case is open.

BRIEF DESCRIPTION OF THE DRAWING

Other objects, features and advantages of the invention, its organization, construction and operation will be best understood from the following detailed description, taken in conjunction with the accompanying drawing, on which.

DESCRIPTION OF THE PREFERRED EMBODIMENTS

Figure 1:
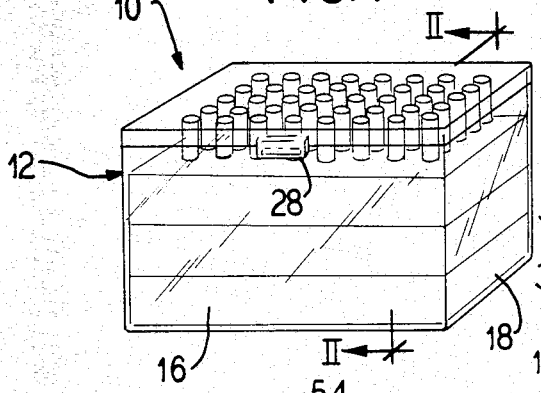
FIG. 1 is a perspective view of a package structure constructed in accordance with the present invention.
Figure 2:
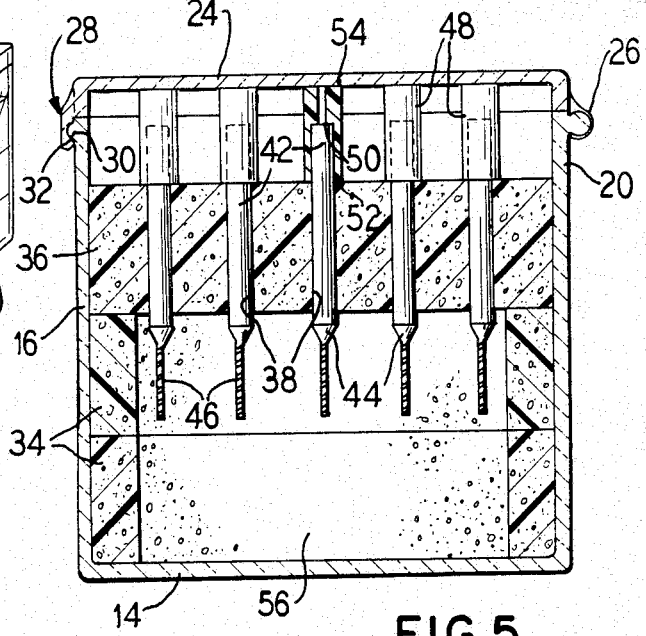
FIG. 2 is a sectional view taken generally along the parting line II—II of FIG. 1 illustrating the first embodiment of the invention.
Figure 3:
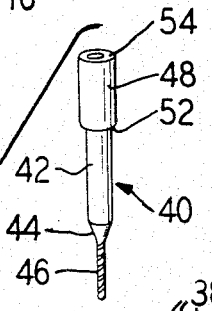
FIG. 3 is an exploded view, shown with the case open, of the package of FIGS. 1 and 2.
Figure 3:
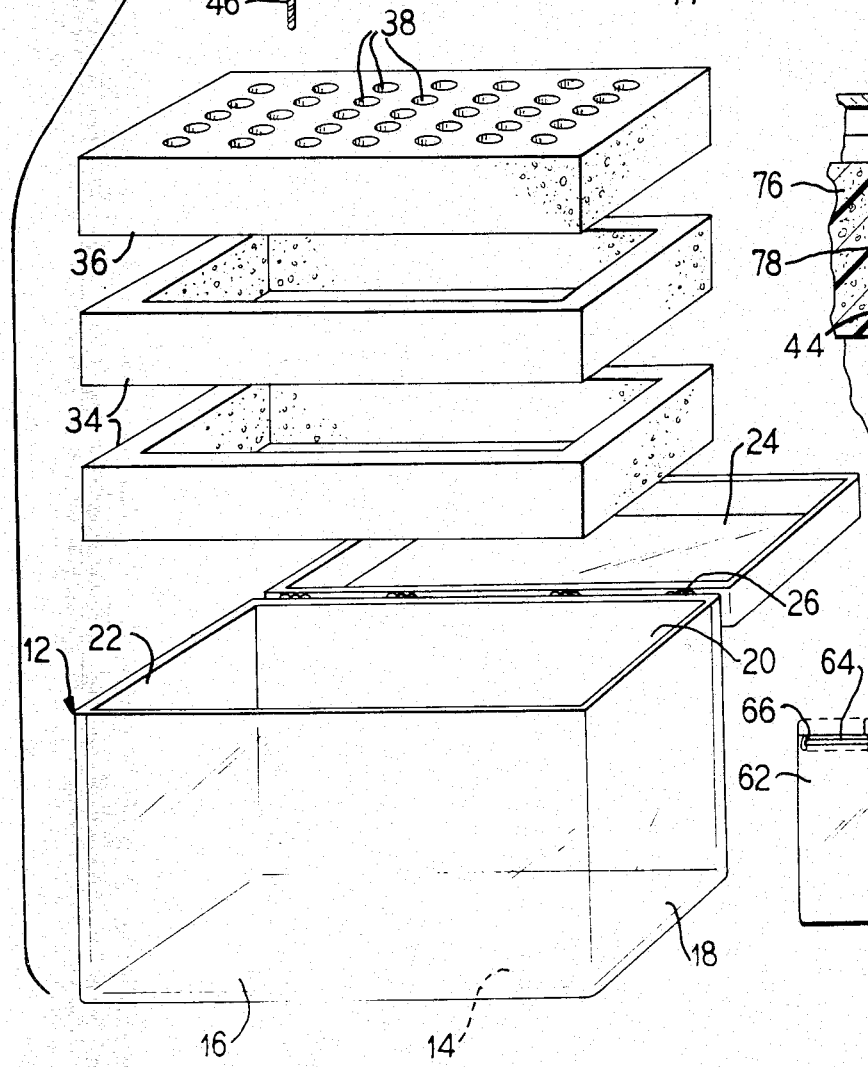

Referring to FIGS. 1–3, a package is generally illustrated at 10 as comprising a case 12 which includes a bottom 14, a plurality of sidewalls 16–20, and a cover 24 which is hinged at 26 to the wall 20. The cover is provided with a latch 28 which includes a resilient flap having a ramp-type inner surface 30 which flexes and snaps over a ridge 32. This latch is by way of example only in that various other latching mechanisms may be employed.

Within the case 12 one or more spacer rings 34 of resilient material are provided about the inner periphery to support a resilient inner wall member 36 and form a cavity 56 which is limited by the rings 34, the lower surface of the inner wall member 36 and the upper surface of the bottom 14. The inner wall member 36 has an array of cylindrical passageways 38 therethrough so as to receive and space a plurality of microdrills.

Referring in particular to FIGS. 2 and 3, each microdrill 40 comprises a shaft 42, a drill body 46 and a conical section 44 connecting the shaft 42 to the drill body 46. As an example to illustrate how delicate a microdrill may be, the shaft 42 may have a diameter of less than 0.1250" and the drill body may have a diameter of less than 0.0060". As illustrated, the microdrills are each fitted with a tube 48 which may have an inner stop surface 50 for abutting the end of the shank, a forward surface 52 for engaging the upper surface of the internal wall member 36 and a rear surface 54 which is engaged by and forms a stop against the inner surface of the cover 54. So positioned, the microdrills are held in a spaced relationship with the drill bodies 46 in the chamber 56 free from any contact with respect to support or with respect to each other. Easy access is provided from the shank end and the package is stable with respect to shock.

Figure 5:
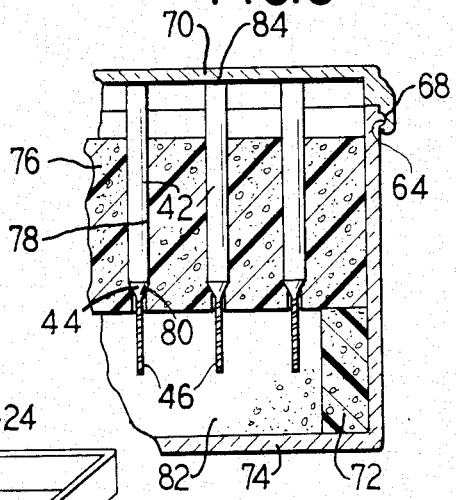
FIG. 5 is a fragmentary sectional view, of the same type of section as FIG. 2, illustrating a second embodiment of the invention and further illustrating a sliding cover.
Figure 4:
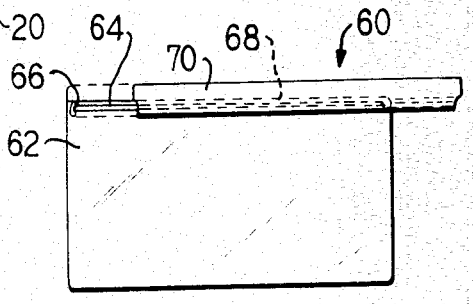
FIG. 4 is a side elevation of a package of the present invention shown with a sliding cover.

It should be pointed out that this embodiment of the invention may also utilize a sliding cover as illustrated in FIGS. 4 and 5.

Turning now to FIGS. 4 and 5, another embodiment of the invention is illustrated at 60 as having, on both sides of the case, a track 64 which is received in a groove 68 of a cover 70. The track 64 is carried on a sidewall 62 and is provided with an end stop 66.

In FIG. 5, a resilient spacing ring 72 supports an internal wall member 76 on the bottom 74. The internal wall member is provided with a plurality of shaped passageways 78 each including a surface 80 which is complemental to the shape of the conical section 44 and which engages the conical section 44 and acts as a lower stop. In this embodiment, the resilient tubes 48 are not employed and the inner surface of the cover 70 engages the rear end 84 of the shanks 42.

Advantageously, the bottom 74 will also be transparent for inspecting the drill bodies.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be inclined within the scope of our contribution to the art.

We claim:

1. A package structure for supporting a protecting a plurality of microdrills each including a shank and a drill body, comprising:

a case including a bottom, a plurality of sidewalls extending from said bottom and forming the periphery of said case, and a cover mounted for opening and closing said case;

cavity means in said case including a shock-absorbing internal wall member extending between said sidewalls spaced from said bottom, said sidewalls and said internal wall member and said bottom forming a cavity, said shock-absorbing internal wall member including hole means defining a plurality of spaced holes therethrough for receiving and embracing the shanks of the microdrills with the drill bodies located and spaced free of contact with said shock-absorbing internal wall member, with one another and with said case within said cavity; and holding means, including said cover, for holding the microdrills in spaced fixed positions when said cover is closed.

2. The package structure according to claim 1, wherein:

at least said bottom of said case comprises transparent material so that the drill bodies may be inspected without removal from the package structure.

3. The package structure according to claim 1, and further comprising:

hinge means connecting said cover to one of said sidewalls; and latch means including a first latch member on said cover and a cooperable second latch member on the sidewall opposite said one sidewall for latching said cover in the closed condition.

4. The package structure according to claim 1, wherein:

said shock-absorbing internal wall member comprises foam material.

5. The package structure according to claim 1, wherein:

said shock-absorbing internal wall member comprises resilient material.

6. The package structure according to claim 4, wherein:

said hole means comprises cylindrical hole surfaces for said holes; and said holding means comprises a plurality of resilient tubes of predetermined length each including a first end to receive and grip the shank of a microdrill, a first end surface for engaging and forming a first stop against said shock-absorbing internal wall member, and a second end surface for engaging and forming a second stop with said cover when said cover is in the closed condition.

7. The package structure according to claim 4, for microdrills which have stepped profiles with a least one surface oblique to the surface of the shank, wherein:

said hole means comprises hole surfaces complemental to and forming first stops for the one surfaces; and said cover including a surface for engaging and forming second stops against the ends of the shanks.

8. The package structure according to claim 1, wherein said cavity means further comprises:

at least one spacer ring within said case supported by said bottom and supporting said internal wall member.

9. The package structure according to claim 1, wherein:

said shock-absorbing internal wall member comprises foam material; and said cavity means further comprises at least one ring of foam material supported on said bottom and supporting said shock-absorbing internal wall member.

10. The package structure according to claim 1, and further comprising:

means slidingly engaging said cover and a pair of said sidewalls.

11. A package structure for supporting and protecting a plurality of microdrills each including a drill profile defined by a shank and a drill body connected by at least one intermediate section, comprising:

a case including a transparent bottom, a plurality of sidewalls extending from said bottom and defining an open top, and a cover movably mounted to at least one of said sidewalls for opening and closing said top;

a shock-absorbing foam member including means defining a plurality of spaced holes therethrough for receiving and embracing the shanks of said microdrills;

a shock-absorbing foam ring of predetermined height carried on said bottom and supporting said shock-absorbing foam member, said shock-absorbing foam member and said shock-absorbing foam ring and said bottom forming a cavity in which the drill bodies are received spaced and free of contact with said shock-absorbing member and ring, with one another and with said bottom of said case; and a plurality of resilient tubes each including a first end for frictionally receiving a microdrill shank, a first end surface for engaging said shock-absorbing foam member as a stop in the direction of the cavity, and a second end surface for engaging said cover when the same is closed as a stop in the opposite direction.

12. The package structure according to claim 11, and further comprising:

hinge means connecting said cover to one of said sidewalls; and latch means including a first latch member on said cover and a cooperable second latch member on another of said sidewalls.

13. The package structure according to claim 11, and further comprising:

slide means slidably mounting said cover to a pair of said sidewalls.

14. The package structure according to claim 13, wherein:

said slide means comprises means defining a pair of grooves in opposite sidewalls for slidingly receiving said cover.

15. The package structure according to claim 13, wherein:

said slide means comprises means defining a track on a pair of opposite sidewalls; and means defining grooves on opposite edges of said cover for slidingly receiving said tracks.

16. The package structure according to claim 12, wherein:

said slide means comprises first means on said cover and second means on opposite sidewalls, one means comprising grooves for slidingly receiving the other of said means.

17. A package structure for supporting and protecting a plurality of microdrills each including a drill profile defined by a shank and a drill body connected by at least one intermediate section, comprising:

a case including a transparent bottom, a plurality of sidewalls extending from said bottom and defining an open top;

a shock-absorbing foam member including means defining a plurality of spaced holes therethrough each shaped complemental to the drill shank and intermediate section of the drill profile, for receiving and embracing the shank of said microdrills, each of said holes including a surface for engaging and forming a stop against the intermediate section;

a shock-absorbing foam ring of predetermined height carried on said bottom and supporting said shock-absorbing foam member, said shock-absorbing foam member and said shock-absorbing foam ring and said bottom forming a cavity in which the drill bodies are received spaced and free of contact with said shock-absorbing foam member, with said shock-absorbing foam ring, with one another and with said bottom of said case; and a cover movably mounted to at least one of said sidewalls for opening and closing said top and engaging the ends of the shanks as a stop against movement of the microdrills out of said shock-absorbing member.

18. The package structure according to claim 17, and further comprising:

slide means slidably mounting said cover to a pair of said sidewalls.

19. The package structure according to claim 18, wherein:

said slide means comprises means defining a pair of grooves in opposite sidewalls for slidingly receiving said cover.

20. A package structure for supporting and protecting a plurality of microdrills each having a shank with a free end, a drill body and an oblique surfaced section connecting the shank to the drill body, comprising:

a hollow box including an inner bottom surface, a cover mounted to open and close and including an inner upper surface, and a plurality of sidewalls extending from said inner bottom surface;

a shock-absorbing dividing wall mounted within said box and including an upper surface and a lower surface;

mounting means mounting said shock-absorbing dividing wall with its lower surface spaced from said bottom surface and its upper surface spaced a predetermined distance from said inner upper surface of said cover to form upper and lower cavities;

an array of passageways extending through said shock-absorbing dividing wall providing communication between said upper and lower cavities and for embracing the shanks of the microdrills; and holding means, including said inner surface of said cover, for holding the plurality of microdrills in respective passageways with the shanks extending into said upper cavity for access when said cover is open and the drill bodies extending protected and free of contact with one another and with the package structure in said lower cavity.

21. A package structure for supporting and protecting a plurality of microdrills each including a shank and a drill body, comprising:

a case including a bottom, at least one sidewall extending from said bottom and forming the periphery of said case, and a cover mounted for opening and closing said case;

cavity means in said case including a shock-absorbing internal wall member extending between said sidewall and spaced from said bottom, said sidewall and said shock-absorbing internal wall member and said bottom forming a cavity, said shock-absorbing internal wall member including hole means defining a plurality of spaced holes therethrough for receiving and embracing the shanks of the microdrills with the drill bodies located and spaced free of contact with the package and with one another within said cavity; and holding means, including said cover, for holding the microdrills in spaced fixed positions when said cover is closed.

22. A package comprising:

a plurality of microdrills each including a shank and a drill body;

a case including a bottom, at least one sidewall extending from said bottom and forming the periphery of said case, and a cover mounted for opening and closing said case;

cavity means in said case including a shock-absorbing internal wall member extending across said case transversely of said at least one sidewall and spaced from said bottom, said at least one sidewall and said shock-absorbing internal wall member and said bottom forming a cavity, said shock-absorbing internal wall member including hole means defining a plurality of spaced holes therethrough for receiving and embracing the shanks of the microdrills with the drill bodies located and spaced free of contact with one another and with the package within said cavity; and holding means, including said cover, for holding the microdrills in spaced fixed positions when said cover is closed.

* * * * *

UNITED STATES PATENT AND TRADEMARK OFFICE

CERTIFICATE OF CORRECTION

PATENT NO. : 4,503,972

DATED : March 12, 1985

INVENTOR(S) : Jerome M. Nelligan and Dale R. Heminover

It is certified that error appears in the above-identified patent and that said Letters Patent is hereby corrected as shown below:

Column 4, line 27, "inclined" should be "included."

Signed and Sealed this

*Nineteenth* Day of *August 1986*

[SEAL]

*Attest:*

DONALD J. QUIGG

*Attesting Officer*

*Commissioner of Patents and Trademarks*